US006430843B1

(12) United States Patent
Potter et al.

(10) Patent No.: US 6,430,843 B1
(45) Date of Patent: Aug. 13, 2002

(54) DYNAMICALLY-CONTROLLED CUSHIONING SYSTEM FOR AN ARTICLE OF FOOTWEAR

(75) Inventors: Daniel R. Potter, Forest Grove; Allan M. Schrock, Portland, both of OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/552,163

(22) Filed: Apr. 18, 2000

(51) Int. Cl.[7] ..... A43B 13/20
(52) U.S. Cl. ..... 36/29; 36/28; 36/43; 36/44
(58) Field of Search ..... 36/28–29, 35 B, 36/3 R, 3 B, 35 K, 153, 154, 43–44, 88, 93, 71

(56) References Cited

U.S. PATENT DOCUMENTS

| | | | | |
|---|---|---|---|---|
| 900,867 | A | | 10/1908 | Miller |
| 1,069,001 | A | | 7/1913 | Guy |
| 1,304,915 | A | | 5/1919 | Spinney |
| 2,645,865 | A | | 7/1953 | Town |
| 2,677,906 | A | | 5/1954 | Reed |
| 2,762,134 | A | | 9/1956 | Town |
| 4,129,951 | A | | 12/1978 | Petrosky |
| 4,183,156 | A | | 1/1980 | Rudy |
| 4,217,705 | A | | 8/1980 | Donzis |
| 4,358,902 | A | | 11/1982 | Cole et al. |
| 4,446,634 | A | | 5/1984 | Johnson et al. |
| 4,662,087 | A | | 5/1987 | Beuch |
| 4,670,995 | A | | 6/1987 | Huang |
| 4,722,131 | A | | 2/1988 | Huang |
| 4,744,157 | A | | 5/1988 | Dubner |
| 4,763,426 | A | | 8/1988 | Polus et al. |
| 4,874,640 | A | | 10/1989 | Donzis |
| 4,912,861 | A | | 4/1990 | Huang |
| 4,991,317 | A | | 2/1991 | Lakic |
| 4,999,932 | A | | 3/1991 | Grim |
| 5,025,575 | A | | 6/1991 | Lakic |
| 5,158,767 | A | | 10/1992 | Cohen et al. |
| 5,179,792 | A | | 1/1993 | Brantingham |
| 5,230,249 | A | * | 7/1993 | Sasaki et al. ..... 73/174 |
| 5,235,715 | A | | 8/1993 | Donzis |
| 5,238,231 | A | | 8/1993 | Huang |
| 5,253,435 | A | | 10/1993 | Auger et al. |
| 5,335,382 | A | | 8/1994 | Huang |
| 5,406,719 | A | | 4/1995 | Potter |
| 5,425,184 | A | | 6/1995 | Lyden et al. |
| 5,524,364 | A | | 6/1996 | Cole et al. |
| 5,558,395 | A | | 9/1996 | Huang |
| 5,595,004 | A | | 1/1997 | Lyden et al. |
| 5,625,964 | A | | 5/1997 | Lyden et al. |
| 5,669,161 | A | | 9/1997 | Huang |

(List continued on next page.)

FOREIGN PATENT DOCUMENTS

| | | |
|---|---|---|
| EP | 0 094 868 | 5/1983 |
| FR | 1406610 | 11/1965 |
| FR | 2614510 | 4/1987 |
| GB | 14955 | 8/1893 |
| GB | 7441 | 3/1906 |
| RO | App. 75100322 | 1/1975 |
| WO | WO 00/64293 | 11/2000 |

*Primary Examiner*—Mickey Yu
*Assistant Examiner*—Jila M. Mohandesi
(74) *Attorney, Agent, or Firm*—Banner & Witcoff, Ltd.

(57) ABSTRACT

An article of footwear with a dynamically-controlled cushioning system is disclosed. The cushioning system includes a sealed, fluid-filled bladder formed with a plurality of separate cushioning chambers, and a control system. The control system, which includes a CPU, pressure sensors and valves, controls fluid communication between the chambers to dynamically adjust the pressure in the cushioning chambers for various conditions such as the activity that the footwear is used in, the weight of the individual and the individual's running style. Certain adjustments can be made while the footwear is in use.

6 Claims, 5 Drawing Sheets

U.S. PATENT DOCUMENTS 5,704,137 A 1/1998 Dean et al.
5,713,141 A 2/1998 Mitchell et al.
5,771,606 A 6/1998 Litchfield et al.
5,813,142 A 9/1998 Demon
5,826,349 A 10/1998 Goss
5,830,553 A 11/1998 Huang
5,832,630 A 11/1998 Potter
5,846,063 A 12/1998 Lakic
5,902,660 A 5/1999 Huang
5,907,911 A 6/1999 Huang
5,937,462 A 8/1999 Huang
5,950,332 A 9/1999 Lain
5,979,078 A 11/1999 McLaughlin
5,987,779 A * 11/1999 Litchfield et al. ..... 36/29
6,055,746 A 5/2000 Lyden et al.
6,085,444 A 7/2000 Cho

* cited by examiner

DYNAMICALLY-CONTROLLED CUSHIONING SYSTEM FOR AN ARTICLE OF FOOTWEAR

FIELD OF THE INVENTION

This invention relates to a cushioning system for an article of footwear. In particular, the cushioning system includes a fluid-filled bladder having separate reservoir chambers. The chambers are in fluid communication with each other, and a control device dynamically-distributes and regulates pressure within the chambers based on sensed and user input criteria.

BACKGROUND OF THE INVENTION

Articles of footwear, such as the modern athletic shoes, are highly refined combinations of many elements which have specific functions, all of which work together for the support and protection of the foot. Athletic shoes today are as varied in design and purpose as are the rules for the sports in which the shoes are worn. Tennis shoes, racquetball shoes, basketball shoes, running shoes, baseball shoes, football shoes, walking shoes, etc. are all designed to be used in very specific, and very different, ways. They are also designed to provide a unique and specific combination of traction, support and protection to enhance performance.

Moreover, physical differences between wearers of a specific shoe, such as differences in each user's weight, foot size, shape, activity level, and walking and running style, make it difficult to economically optimize a mass produced shoe's performance to a particular individual.

Closed-celled foam is often used as a cushioning material in shoe soles and ethylene-vinyl acetate copolymer (EVA) foam is a common material. In many athletic shoes, the entire midsole is comprised of EVA. While EVA foam can be cut into desired shapes and contours, its cushioning characteristics are limited. One of the advantages of fluid, in particular gas, filled bladders is that gas as a cushioning component is generally more energy efficient than closed-celled foam. Cushioning generally is improved when the cushioning component, for a given impact force, spreads the impact force over a longer period of time, resulting in a smaller impact force being transmitted to the wearer's body. Thus, fluid-filled bladders are routinely used as cushions in such shoes to increase shoe comfort, enhance foot support, decrease wearer fatigue, and reduce the risk of injury and other deleterious effects. In general, such bladders are comprised of elastomeric materials which are shaped to define at least one pressurized pocket or chamber, and usually include multiple chambers arranged in a pattern designed to achieve one or more of the above-stated characteristics. The chambers may be pressurized with a variety of different mediums, including air, various gases, water, or other liquids.

Numerous attempts have been made to improve the desirable characteristics associated with fluid-filled bladders by attempting to optimize the orientation, configuration and design of the chambers. In U.S. Pat. No. 2,080,469 to Gilbert, bladders have been constructed with a single chamber that extends over the entire area of the sole. Alternatively, bladders have included a number of chambers fluidly interconnected with one another. Examples of these types of bladders are disclosed in U.S. Pat. No. 4,183,156 to Rudy, and U.S. Pat. No. 900,867 to Miller. However, these types of bladder constructions have been known to flatten and "bottom out" when they receive high impact pressures, such as experienced in athletic activities. Such failures negate the intended benefits of providing the bladder.

In an effort to overcome this problem, bladders have been developed with the chambers fluidly connected to each other by restricted openings. Examples of these bladders are illustrated in U.S. Pat. No. 4,217,705 to Donzis, U.S. Pat. No. 4,129,951 to Petrosky, and U.S. Pat. No. 1,304,915 to Spinney. However, these bladders have tended to either be ineffective in overcoming the deficiencies of the non-restricted bladders, or they have been too expensive to manufacture.

Bladders are also disclosed in patents that include a number of separate chambers that are not fluidly connected to each other. Hence, the fluid contained in any one chamber is precluded from passing into another chamber. One example of this construction is disclosed in U.S. Pat. No. 2,677,906 to Reed. Although this design obviates "bottoming out" of the bladder, it also requires each chamber to be individually pressurized, thus, the cost of production can be high.

Another problem with these known bladder designs is that they do not offer a way for a user to individually adjust the pressure in the chambers to optimize their shoes' performance for their particular sport or use. Several inventors have attempted to address this issue by adding devices that make the chamber pressure adjustable. For example, U.S. Pat. No. 4,722,131 to Huang discloses an open system type of air cushion. The air cushion has two cavities, with each cavity having a separate air valve. Thus, each cavity can be inflated to a different pressure by pumping in or releasing air as desired.

However, in such systems, a separate pump is required to increase the pressure in the cavities. Such a pump would have to be carried by the user if it is desired to inflate the cavities away from home, inconveniencing the user. Alternatively, the pump could be built into the shoe, adding weight to the shoe and increasing the cost and complexity. Additionally, open systems tend to lose pressure rapidly due to diffusion through the bladder membrane or leakage through the valve. Thus, the pressure must be adjusted often.

A significant improvement over this type of design is found in U.S. Pat. No. 5,406,719 to Potter ("Potter"), the disclosure of which is hereby incorporated by reference. Potter controllably links a plurality of chambers within a bladder with at least one variable-volume fluid reservoir such that the pressure in each chamber may be manually adjusted by a user modulating selected control links and the volume of the reservoir. The chambers may be oriented to allow chambers of different pressure in areas corresponding with different areas of the foot. For example, to correct over-pronation, pressure in chambers located on the medial side of the shoe can be selectively increased by the user.

The system in Potter is also closed to the atmosphere. Accordingly, pressure in the system may be higher than ambient pressure. Moreover, dirt and other debris cannot enter the system.

However, since Potter requires manual adjustment, the pressure in the various chambers cannot be dynamically modulated or adjusted during use of the shoe. Accordingly, considerable user effort is required to "fine tune" the performance of the shoe for a particular use and individual, and such adjustments must be re-done by the user when the sport or activity changes.

In recent years, consumer electronics have become increasingly more reliable, durable, light-weight, economical, and compact. As a result, the basic elements of a miniaturized fundamental control system, such as a central processing unit, input/output device, data sensing devices, power supplies, and micro actuators are now commercially available at reasonable prices. Such systems are small, light-weight, and durable enough to be attached to an article of footwear, such as a shoe, without compromising the shoe's performance.

A control system to permit dynamic adjustment to the pressure in a single chamber cushioning bladder is disclosed in U.S. Pat. No. 5,813,142 to Demon ("Demon"), the disclosure of which is hereby incorporated by reference. In Demon, a plurality of single-chamber independent bladders are secured within a shoe and in fluid communication with ambient air through fluid ducts. A control system monitors the pressure in each bladder. Each duct includes a flow regulator, that can be actuated by the control system to any desired position such that the fluid duct can be modulated to any position between and including being fully open and fully closed. The control system monitors the pressure in each of the bladders, and opens the flow regulator as programmed based on detected pressure in each bladder.

Despite the benefits of using an on-board control system to dynamically modulate bladder pressure in each bladder of Demon, the specific implementation of this concept taught by Demon adversely affects performance of the bladder as a cushion, thereby significantly limiting the commercial viability of the concept. For example, the plurality of bladders in Demon each have their own reservoir, which is preferably ambient air. Accordingly, the static pressure in each bladder cannot exceed ambient pressure. In practice, it is desirable for the static pressure in the bladder to be higher than ambient pressure. Such higher pressures the bladder to return to its neutral position following impact, prevents bottoming out of the bladder, and improves the cushioning ability, or feel, of the bladder.

Also, like other bladder configurations that exhaust to ambient air, the bladders in Demon are prone to collect dirt and other debris through their exit/inlet port, particularly when a user wears the shoe outdoors, such as when running on wet pavement. Moreover, Demon neither teaches nor suggests dynamically-modulating pressure between at least two chambers within the same bladder thereby allowing the control system to optimize performance within all areas of the bladder without compromising the integrity of the system, and without requiring multiple bladders within the same shoe.

Accordingly, despite the known improvements to bladder designs, there remains a need for a cost effective, closed-system, multi-chamber bladder that allows pressure in each chamber to be dynamically distributed, adjusted, and regulated between each chamber based on real-time sensed and user input criteria to optimize the desirable characteristics of the bladder while the shoe is being worn by its user.

In addition to other benefits that will become apparent in the following disclosure, the present invention fulfills this need.

SUMMARY OF THE INVENTION

The present invention is a cushioning system for an article of footwear that includes a fluid-filled bladder having a plurality of separate sealed cushioning chambers. Separate reservoir chambers can also be placed in fluid communication with the cushioning chambers. The chambers are in fluid communication with each other, and a control device dynamically-distributes and regulates pressure within the chambers based on sensed and user input criteria by modulating the level of fluid communication between each of the chambers and, if installed, the reservoir chambers.

In a preferred embodiment, the control system includes a central processing unit (CPU), pressure sensing devices, and electronically-actuated, CPU-commanded valves that work in conjunction to control fluid communication between the chambers, and if desired, with a variable volume reservoir to optimize performance of the cushioning system for a particular wearer and activity.

DETAILED DESCRIPTION OF A PREFERRED EMBODIMENT

Figure 1:
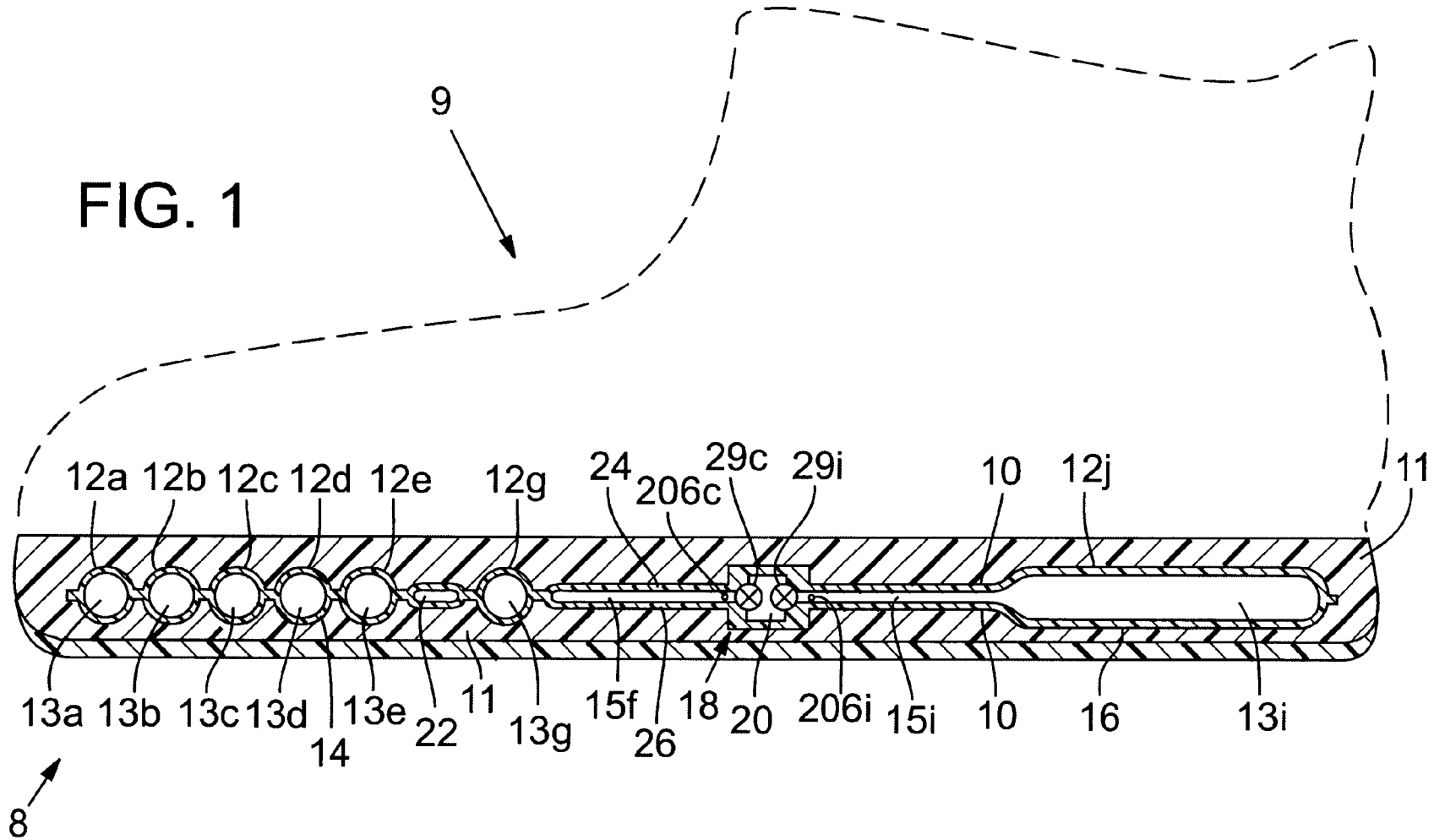
FIG. 1 is a cross-sectional view through a shoe of the present invention, incorporating bladder in accordance with a preferred embodiment of the present invention.

A cushioning system 8 for use in an article of footwear 9 is disclosed in FIGS. 1 to 9. The cushioning system 8 includes a bladder 10 having a plurality of chambers 12*a–j* in fluid connection with each other at plenum 20 with each chamber entrance having an individually operable regulator, such as a modulating valve 29. A control system monitors pressure in the chambers and dynamically operates the regulators to change the level of fluid communication between the chambers, thereby changing their respective pressures, to optimize performance of the bladder while the article of footwear is being worn.

A. Bladder Assembly

In a preferred embodiment of the invention (FIGS. 1–3), a bladder 10 is a thin, elastomeric member defining a plurality of chambers 12 or pockets. The chambers 12 are pressurized to provide a resilient support. Bladder 10 is particularly adapted for use in the midsole of the shoe, but could be included in other parts of the sole or have applicability in other fields of endeavor. In a midsole, bladder would preferably be encapsulated in an elastomeric foam 11 (FIG. 1). As is well known in the art, the foam need not fully encapsulate the bladder. Moreover, the bladder can be used to form the entire midsole or sole member.

Preferably, bladder 10 is composed of a resilient, plastic material including polyester polyurethane, polyether polyurethane, such as a cast or extruded ester base polyurethane film having a shore "A" harness of 80 to 95 (e.g., Tetra Plastics TPW-250) which is inflated with hexafluorethane (e.g., Dupont F-116) or sulfer hexafluoride. Other suitable materials and fluids having the requisite characteristics can be used, such as those disclosed in U.S. Pat. No. 4,183,156 to Rudy, which is incorporated by reference. Among the numerous thermoplastic urethanes which are particularly useful in forming the film layers are urethanes such as Pellethane, (a trademarked product of the Dow Chemical Company of Midland, Mich.), Elastollan (a registered trademark of the BASF Corporation) and ESTANE (a registered trademark of the B. F. Goodrich Co.), all of which are either ester or ether based and have proven to be particularly useful. Thermoplastic urethanes based on polyesters, polyethers, polycaprolactone and polycarbonate macrogels can also be employed. Further suitable materials could include thermoplastic films containing crystalline material, such as disclosed in U.S. Pat. Nos. 4,936,029 and 5,042,176 to Rudy, which are incorporated by reference; polyurethane including a polyester polyol, such as disclosed in U.S. Pat. No. 6,013,340 to Bonk et al., which is incorporated by reference; or multi-layer film formed of at least one elastomeric thermoplastic material layer and a barrier material layer formed of a copolymer of ethylene and vinyl alcohol, such as disclosed in U.S. Pat. No. 5,952,065 to Mitchell et al., which is incorporated by reference. Further, the bladders 10 can also be fabricated by blow molding or vacuum forming techniques.

As a bladder midsole, bladder 10 defines a forefoot support 14, a heel support 16, a medial segment 18 interconnecting the two supports. Chambers 12 each define a support portion 13 and a channel portion 15. The support portions 13 are raised to provide a resilient resistance force for an individual's foot. The channel portions 15 are relatively narrow in comparison to the support portions 13, and are provided to facilitate the unique manufacturing process described below. Forefoot and heel supports 14, 16 are comprised primarily of support portions so that a cushioned support is provided under the plantar areas receiving the greatest impact pressure during use of the shoe. Channel portions 15, while extending partially into the forefoot and heel supports 14, 16, are concentrated in medial segment 18.

In forefoot support 14, the support portions 13 are arranged parallel to one another in a lateral direction across the sole to provide a suitable flexibility in the forefront sole portion and to apportion the cushioned resistance as desired. Nonetheless, different chamber arrangements could be used.

In the illustrated athletic shoe, forefoot portion 14 includes chambers 12*a–g*. Chambers 12*a–g* are of varying sizes, with the chambers nearer to the front (e.g., chamber 12*a*) defining a larger volume than those closer to medial segment 18 (e.g., chamber 12*g*). As will be described more fully below, all of the chambers 12*a–g* are initially pressurized to the same level. However, due to the different volumes of chambers, they will each possess a unique resistance. In other words, the chambers with smaller volumes will provide a firmer support than the chambers with larger volumes, because the movement of a side wall defining a smaller chamber will involve a greater percentage of the volume of air being displaced than the same movement in a larger chamber. Hence, for example, chamber 12*g* will provide a firmer support than chamber 12*a*.

Channel portions 15*a–g* of chamber 12*a–g*, in general extend rearwardly from support portions 13*a–g* to plenum 20 located transversely across medial segment 18. Channel potions 15 are essential to the unique manufacturing process described in U.S. Pat. No. 5,406,719 to Potter, the disclosure of which is hereby incorporated by reference. Preferably, channel portion 15 are provided along the sides of forefoot portion 14, so that the needed cushioned support is not taken from the central portions of the sole where it is most needed. In the illustrated embodiment, channel portions 15 for adjacent chambers 12 are placed on opposite sides of the sole. Of course, other arrangements could be used.

Additionally, in forefoot portion 14, void chambers 22 are defined adjacent the more rearward chambers 12*e–g*. A void chamber 22 is a chamber that has not been pressurized. Void chambers 22 exist because of the need to limit the volume of the chambers 12*e–g* to provide a certain firmness in these portions of the bladder. Nevertheless, void spaces are not essential to the present invention and could be eliminated. In a midsole usage (FIG. 1), the resilient foam 11 would fill in the void space and provide ample support to the user's foot.

In a manner similar to forefoot support 14, heel support 16 includes a row of chambers 12*h–j*. In the illustrated bladder, three chamber 12*h–j* are provided. The support portions 13*h–j* of these chambers are arranged parallel to one another in a generally longitudinal direction across the sole to ensure that all three chambers provide cushioned support for all impacts to the user's heel. Nonetheless, as with the forefoot portion, different chamber arrangements could be used. Additionally, each chamber 12*h–j* includes a channel portion 15 which extends from the support potion 13 to plenum 20. In the same manner as in forefoot support 14, chambers 12*h–j* provide different resistance forces in the support of the heel. For example, the smaller chamber 12*h* will provide a firmer resistance than the larger chambers 12*i* or 12*j*. The firmer chamber 12*h* would act as a medial post in reducing pronation.

Chambers 12*h–j* are initially pressurized in the same internal pressure as chambers 12*a–g*. One preferred example of internal pressure for athletic footwear is 30 psi. Of course, a wide variety of other pressures could be used. Alternatively, chambers 12*a–j* can be pressurized to different internal pressures. As one preferred example, the pressure in the forefoot portion could be set at 35 psi, while the heel portion could be pressurized to 30 psi. The particular pressure in each section though will depend on the intended activity and size of the chambers, and could vary widely from the given examples. Finally, by individually controlling the control valves during inflation, individual chambers can be inflated to different pressures.

Figure 2A:
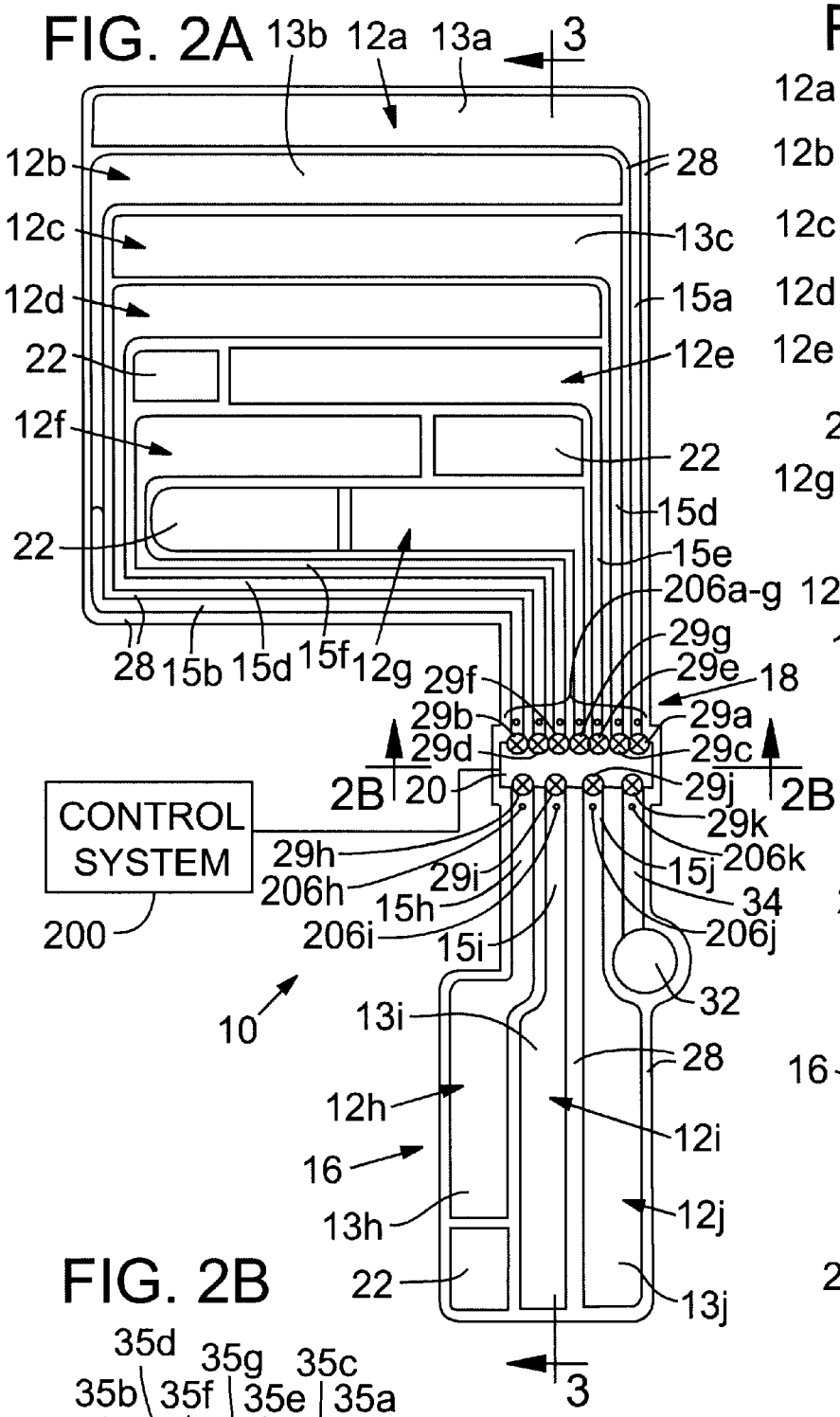
FIG. 2A is a top view of a bladder of the present invention.
Figure 3:
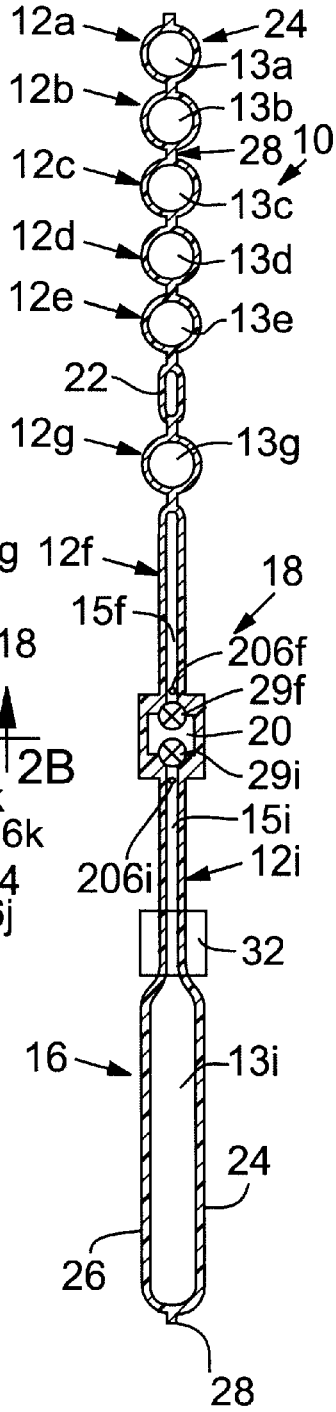
FIG. 3 is a cross-sectional view taken along line 3—3 of FIG. 2A.

In the fabrication of the bladder 10, two elastomeric sheets 24, 26 are preferably secured together to define the particular weld pattern illustrated in FIGS. 2–3; that is, that the two opposed sheets 24, 26 are sealed together to define wall segments 28 arranged in a specific pattern (FIG. 2A). The welding is preferably performed through the use of radio frequency welding, the process of which is well known. Of course, other methods of sealing the sheets could be used. Alternatively, the bladder could also be made by blow molding, vacuum forming, or injection molding, the processes of which are also well known.

When the bladder is initially welded (or otherwise formed), the plenum 20 is fluidly coupled with all of the channel portions of the chambers 12*a–j*, so that all of the chambers are in fluid communication with one another. Each channel portion includes a modulating valve 29*a–k* that is preferably electronically actuated and can be commanded open, closed, or to an infinite position between these two points, thereby regulating change in pressure into and out of its respective chamber 12*a–j*.

Figure 2B:
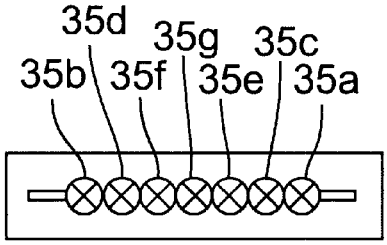
FIG. 2B is a cross-sectional view taken along line 2B—2B of FIG. 2A.

An injection pocket 32 is provided to supply bladder 10 with a quantity of fluid. Injection pocket 32 is in fluid communication with a pressurizing channel 34, which in turn is fluidly coupled to plenum 20 (FIGS. 2A and 2B). Chambers 12*a–j*, therefore, are initially pressurized by inserting a needle (not shown) through one of the walls defining an injection pocket 32, and injecting a pressurized fluid therein. The pressurized fluid flows from pocket 32, through channel 34, into plenum 20, through channel portions 15*a–j* and into the supporting portion 13*a–j* of all of the chambers 12*a–j*. Once the predetermined quantity of fluid has been inserted into the bladder, or alternatively when the desired pressure has been reached, channel 34 is temporarily clamped. Preferred fluids include, for example, hexafluorethane, sulfur hexafluoroide, nitrogen, air, or other gases such as disclosed in the aforementioned '156, '945, '029, or '176 patents to Rudy, or the '065 patent to Mitchell et al.

Walls 24, 26 are welded, or otherwise heat sealed, forming a seal around plenum 20 (FIG. 1) to completely seal the chambers in fluid communication with each other at plenum 20. Once the seal has been made, the needle is removed and channel 34 remains on uninflated void area. Hence, as can be readily appreciated, this unique independent chamber design can be fabricated by the novel process in a easy, quick, and economical manner.

B. Control System Assembly

Figure 9:
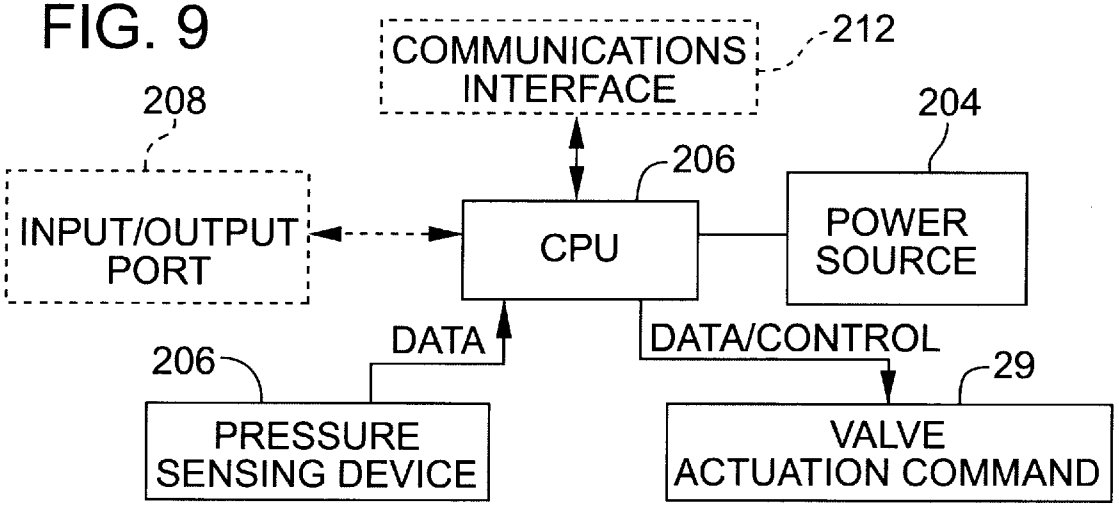
FIG. 9 is a schematic view of a control system in accordance with the present invention.

Referring specifically to FIG. 9, the control system 200 is shown and includes a central processing unit ("CPU") 202, power source 204, a plurality of pressure sensing devices 206*a–k*, and the modulating valves 29*a–k*. Preferably, the system also includes an input device 208, but it is not required.

One pressure sensing device 206*a–k* is positioned adjacent to each modulating valve 29*a–k* such that the pressure in adjacent chamber 12*a–k* is detected. The pressure sensing devices 206*a–j* transmit sensed information to the CPU 202, where it is processed according to preset programming to modulate the respective modulating valves in response to the detected pressures in each chamber. Such control systems and programming logic are known. For example, in U.S. Pat. No. 5,813,142, the pressure sensing devices 206*a–k* include pressure sensing circuitry, which converts the change in pressure detected by variable capacitor into digital data. Each variable capacitor forms part of a conventional frequency-to-voltage converter (FVC) which outputs a voltage proportional to the capacitance of the variable capacitor. An oscillator is electrically connected to each FVC and provides an adjustable reference oscillator. The voltage produced by each pressure sensing device is provided as an input to multiplexer which cycles through the channels sequentially connecting the voltage from each FVC to analog-to-digital (A/D) converter which coverts the analog voltage into digital date for transmission to the CPU via data lines. These components and this circuitry is well known to those skilled in the art and any suitable component or circuitry might be used to perform the same function.

The control system 200 also includes a programmable microcomputer having conventional RAM and ROM, and received information from pressure sensing device 206*a–j* indicative of the relative pressure sensed by each pressure sensing device 206*a–j*. The CPU 202 receives digital data from pressure sensing circuitry proportional to the relative pressure sensed by pressure sensing devices. The control system 200 is also in communication with modulating valves 29*a–j* to vary the opening of each such valves and thus the level of fluid communication of each chamber with the other chambers. As the modulating valves are preferably solenoids (and thus electrically controlled), the control system is in electrical communication with modulating valves.

Figure 8:
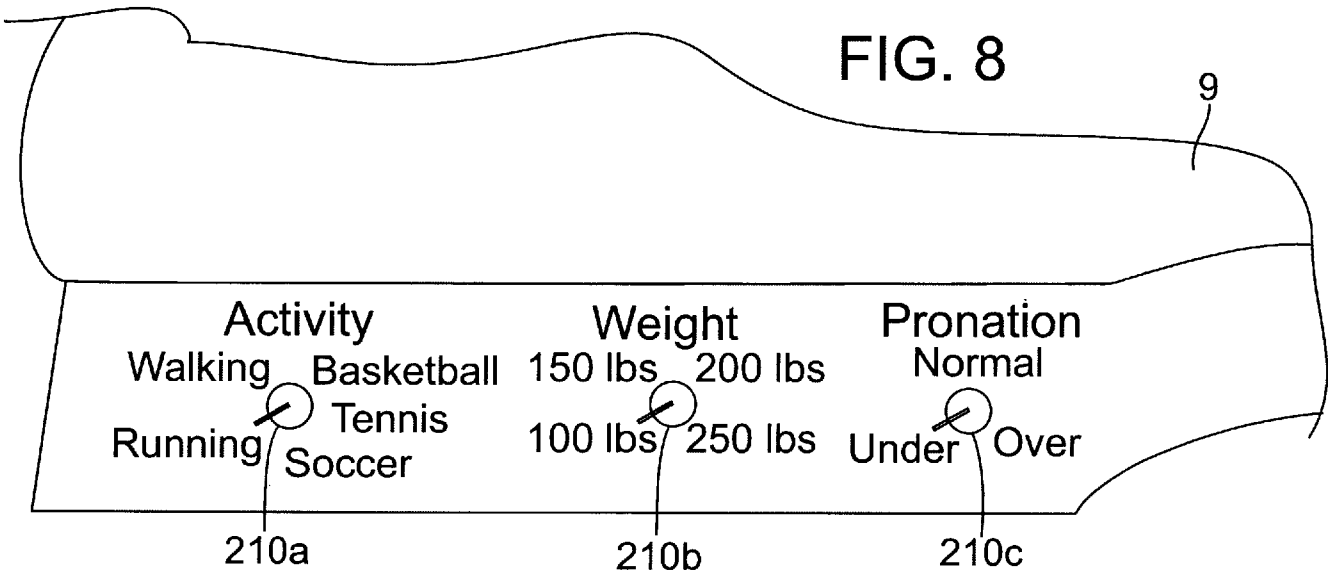
FIG. 8 is a schematic side view of a portion of a shoe, illustrating control knobs.

In a preferable embodiment, the control system also includes a user input devices 208, which allows the user to control the level of cushioning of the shoe. Such devices are known in the art. For example, as shown in FIG. 8, a knob 210*a–c* on the article of footwear 9 is adjusted by the user to indicate a particular sport or activity to be engaged in by the user, the user's weight, and or the type of pronation desired to be corrected. The CPU 202 detects the commanded signal from the input device 208, and adjusts the pressure in the various chambers 12*a–j* accordingly.

The CPU programming may be pre set during manufacturing, or include a communications interface 212 for receiving updated programming information remotely. Such communications ports and related systems are known in the industry. For example, the interface 212 may be a radio frequency transceiver for transmitting updated programming to the CPU. An associated receiver would be installed on the shoe and in electrical communication with the CPU. The interface may alternately, or additionally, have a serial or parallel data port, infrared transceiver, or the like.

C. Variable Volume Reservoir

If desired, one or more variable volume reservoirs 516 as disclosed more fully in U.S. Pat. No. 5,406,719 can be inserted into the bladder and placed in fluid communication with the plenum 20. Such reservoirs 516 preferably include a pressure sensing device 206*l–o* and a modulating valve 518*a–f*, within a channel connecting the reservoir with plenum 20. The volume of the reservoir can be modulated electronically through solenoid 517*a–d*, which causes flat screw 526 to actuate. The control system 200 detects the sensed pressure in the reservoir, and can command the solenoid 517*a–d* and modulating valve 518*a–f* as needed to increase the pressure in any of the chambers 512*a–d*.

Figure 4:
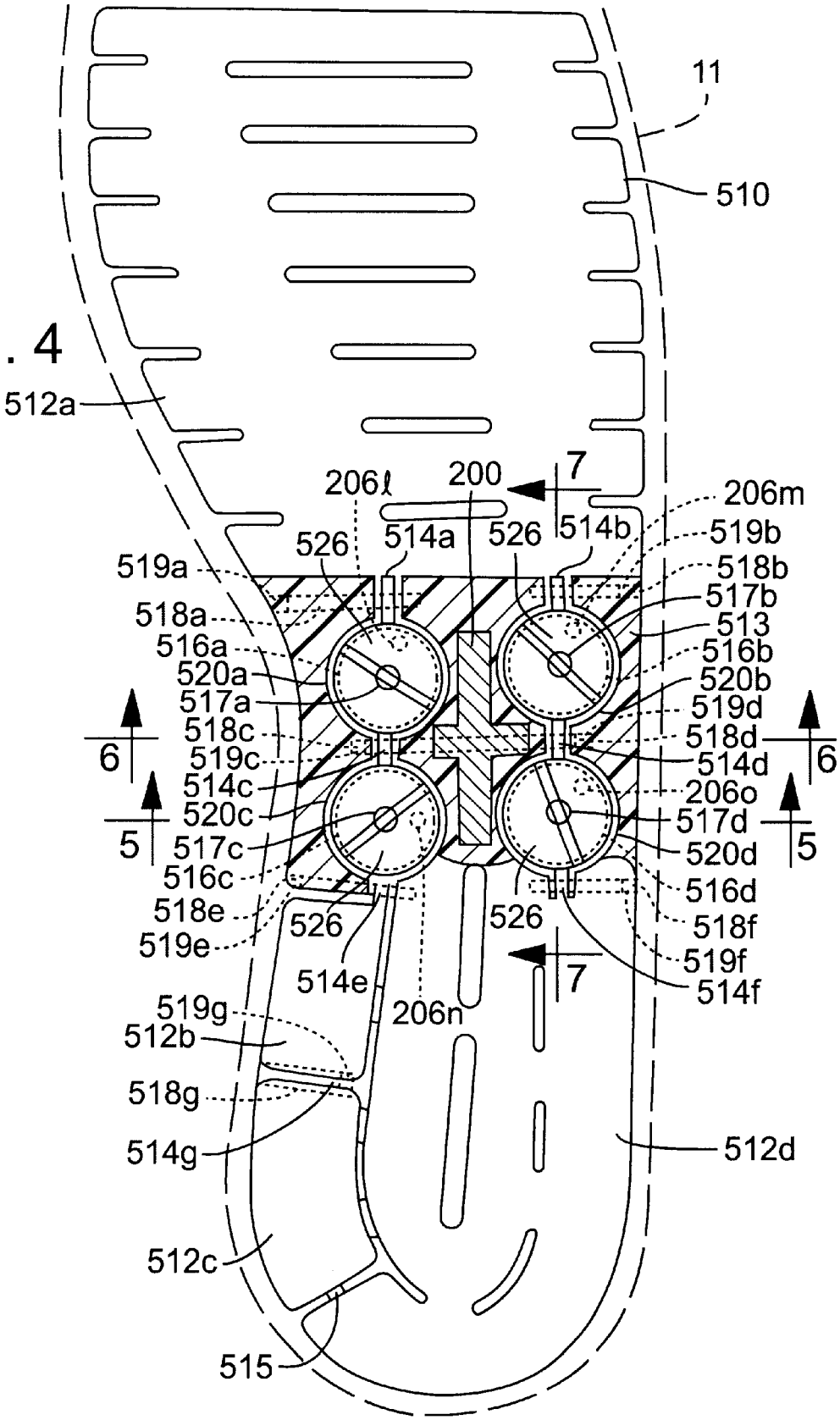
FIG. 4 is a top plan view of another embodiment of bladder of the present invention.

In particular, and as best shown in FIGS. 4–7, the pressurizing of the various chambers 512*a–d* may be selectively varied in a known manner in a closed cushioning system. Referring specifically to FIG. 4, an alternative preferred cushioning element, or bladder, is shown. Bladder 510 preferably includes four separate gas-filled support chambers 512*a–d*. Chambers 512 compress and stiffen when a load is applied in order to provide cushioning but do not collapse upon themselves. Forward medial support chamber 512*b* and rearward medial support chamber 512*c* are disposed on the medial side in the heel region, and extend approximately ½ of the width of the bladder. Lateral chamber 512*d* also is disposed in the heel region, and extends from the medial side for approximately ⅔ of the width of the bladder. Chambers 512*b–d* are spaced from each other.

Chambers 512*b* and 512*c* by interconnecting tube or port 514*g* which may be selectively opened or closed by pinch-off valve 518*g*, the operation of which is discussed in greater detail below. Chambers 512*c* and 512*d* also may be linked by port 515 to facilitate initial pressurization of the chambers. However, as shown in FIG. 4, if desired, port 515 may be permanently sealed to prevent fluid communication between chamber 512*c* and chamber 512*d*. Chamber 512*a* forms the forward portion of cushioning element 510, and extends generally across the width of the sole. Chamber 512*a* is formed as a separate element from chambers 512*b–d*, with foam element 513 disposed therebetween, and if desired can be linked directly in fluid communication with any chambers 512*b–d*.

Foam element 513 forms the arch portion of the cushioning element and includes cylindrical opening 520*a–d* formed partially or fully therethrough. Variable volume reservoir chambers 516*a–d* are disposed within openings 520*a–d*, respectively. Chambers 516*a–d* have a bellows shape which allows the chambers to collapse upon themselves to reduce the volume. Front medial reservoir chamber 516*a* is linked in fluid communication with front support chamber 512*a* by interconnecting tube or port 514*a*, and with rear medial compressible reservoir 516*c* by interconnecting tube 514*c*. Rear medial reservoir chamber 516*c* is linked in fluid communication with forward medial support chamber 512*b* by interconnecting tube 514*c*. Front lateral reservoir chamber 516*b* is linked in fluid communication with front support chamber 512*a* by interconnecting tube 514*b*, and with rear lateral reservoir chamber 516*d* by interconnecting tube 514*d*. Rear lateral reservoir chamber 516*d* is further linked in fluid communication with lateral support chamber 512*d* by interconnecting tube 514*f*. The opening and closing of each of interconnecting tubes 514*a–g* is controlled by a corresponding valve 518*a–g*, described further below.

Cushioning is provided by the confined gas in chambers 512*a–d*, and any load on any part of a given chambers will instantaneously increase the pressure equally throughout the whole chamber. The chamber will compress to provide cushioning, stiffening but not collapsing, due to the increase in pressure of the contained gas. When open, interconnecting tubes 514 do not restrict the fluid communication between support chambers 512 and reservoirs 516, and two support chambers and/or reservoirs connected by an open tube function dynamically as a single chamber. Thus, when all of tubes 514 are open, cushioning element 510 functions as a substantially unitary bladder providing cushioning throughout the midsole.

Figure 5:
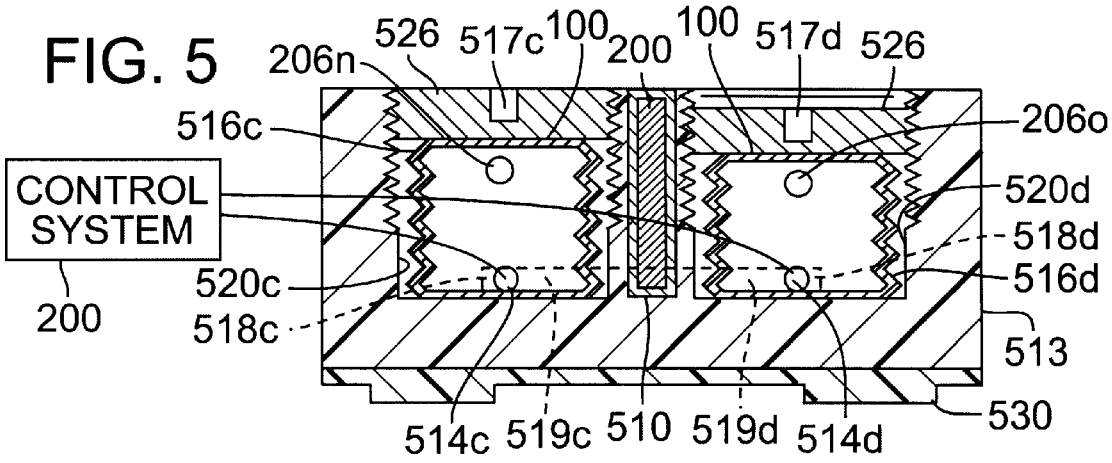
FIG. 5 is a cross-sectional view taken along line 5—5 of FIG. 4.
Figure 6:
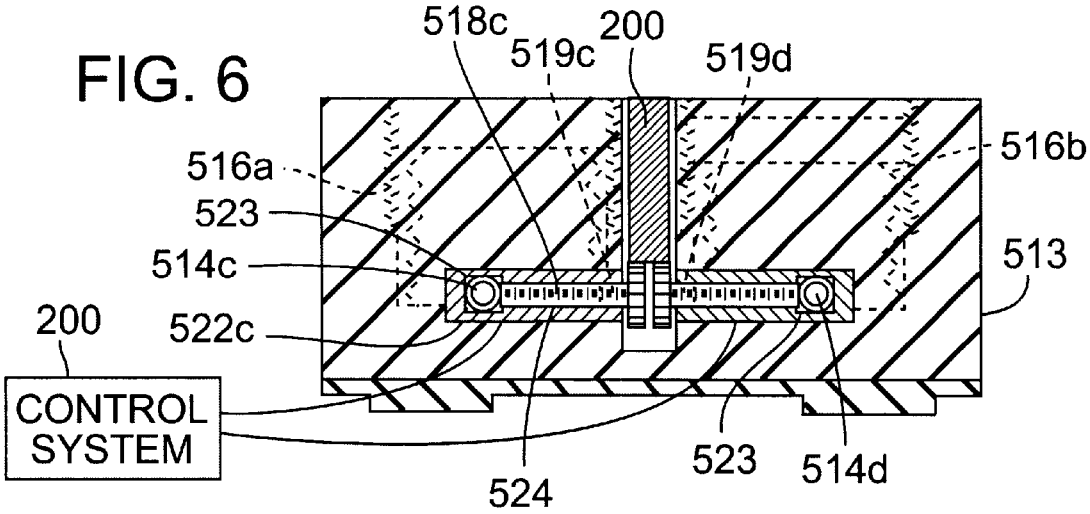
FIG. 6 is a cross-sectional view taken along line 6—6 of FIG. 4.
Figure 7:
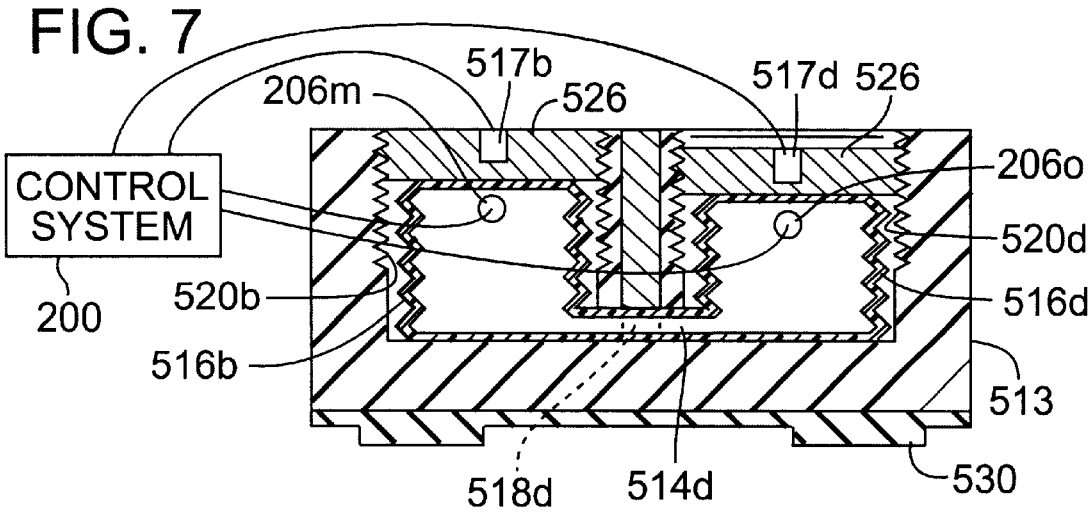
FIG. 7 is a cross-sectional view taken along line 7—7 of FIG. 4.

Valves 518*a–g* may comprise any suitable valve known in the art, for 20 example, a pinch-off valve including a screw as shown in FIGS. 5 and 6. With reference to FIG. 4, valves 518*a–g*, for example, valve 518*c*, includes hollow rivet 522*c* disposed in a hole extending partially throughout foam element 513 from one end thereof, and includes an actuator 519*c* in electrical communication with and commanded by the CPU 202. Rivet 522*c* disposed in a hole extending partially through foam element 513 from one end extending radially therethrough at the inner end. The inner wall of rivet 522*c* is screw-threaded, and adjusting screw 524 is disposed therein and includes actuator 519*c* in electrical communication with and commanded by the CPU. Screws 524 preferably are made of light weight plastic.

Interconnecting tubes 514 are disposed within indented portion 523. The fluid communication may be controlled by adjusting the extent to which screws 524 extend within region 523. When screws 524 are disposed out of contact with tubes 514, there is substantially free fluid communication between reservoirs 516 and/or support chambers 512. When screws 524 are in the innermost position, they fully contact and pinch-off tubes 514, preventing fluid communication substantially completely.

As discussed, reservoirs 516*a–d* are disposed within cylindrical holes 520*a–d* formed in foam element 513. The interior of holes 520 are screw-threaded and form containing chambers for reservoirs 516. Flat screws 526 are disposed in respective openings 520*a–d*. Downward rotation of screws 526 brings the screws into contact with and compresses reservoir chambers 516. Accordingly, each reservoir 516 can be adjusted to and maintained at a desired volume by simple rotation of the corresponding flat screw 526 which causes the reservoir to collapse. When reservoirs 516 are at their maximum volume, the top of screws 526 are level with the top of openings 520. Screws 526 are made of a light weight material, such as plastic, and are manipulated by actuators 517, that are in electrical communication with and commanded by the CPU 202. Pressure sensing devices 206*k–n* are disposed in each reservoir and transmit pressure information to the CPU 202.

Due to the light-weight nature of both screws 526, chambers 516 and foam element 513, only a minimal downward force is needed to collapse reservoirs 516 and retain reservoirs 516 at the desired volume. Thus, only a minimal torque is needed to rotate screws 526 to the desired level. If a sock liner is provided, corresponding hooks could be provided therethrough as well to provide ease of access.

By making use of reservoirs 516*a–d* and tubes 514, the degree of pressurization and thus the stiffness of each support chamber 512*a–d* can be adjusted to provide customized cushioning at different locations of the shoe, without requiring gas to be added to or leaked from the bladder. For example, if it is desired to increase the resistance to compression in the medial rear portion of the shoe, the pressure in one or both of support chambers 512*b* and 512*c* may be increased by the CPU 202 commanding the appropriate actuators until desired pressure is obtained in the appropriate chambers in the following manner. Screw 524 of valve 518*a* would be commanded by the CPU to rotate into contact with connecting tube 514*a*, fully compressing the tube and preventing the fluid communication therethrough so as to isolate medial front reservoir 516*a* from support chamber 512*a*. Reservoir 516*a* would be collapsed by the CPU 202 commanding the rotation of the corresponding flat screw 526, forcing gas therefrom and into reservoir 516*c* and medial support chambers 512*b* and 512*c*. Therefore, reservoir 516*c* also would be collapsed forcing gas therefrom and into medial support chambers 512*b* and 512*c*. Screw 524 of pinch-off valve 518*e* would be commanded by the CPU to rotate so as to compress the connecting tube, isolating reservoirs 516*a* and 516*c* from support chambers 512*b* and 512*c*.

The mass of the gas in chambers 512*b* and 512*c* has been increased, and since chambers 512*b* and 512*c* are now isolated from the other support chambers of the bladder, their effective volume is reduced. Thus, the pressure in chambers 512*b* and 512*c* is increased. As a result, when chambers 512*b* and 512*c* are loaded, element 510 has an increased resistance to compression and is stiffer at the location of support chambers 512*b* and 512*c*. If desired, the resistance to compression of chambers 512*b* and 512*c* can be further increased by the CPU 202 commanding the closing of tube 514*g*, making the chambers independent of each other and decreasing their effective volumes further. Thus, when a load is localized at one or the other of chambers 512*b* or 512*c*, the stiffness of the loaded chamber is increased since fluid communication to the other chamber is prevented. For most people, during walking or running the foot rolls forwardly from the heel. Thus, chamber 512*c* experiences maximum loading separately from chamber 512*b*. As the foot rolls forwardly, the stiffness of each chamber is increased as it receives the maximum load beyond the maximum stiffness when the chambers are in communication. Accordingly, the overall stiffness experienced by the wearer is increased.

The pressure in both of chambers 512*b* and 512*c* could be further increased by the CPU 202 commanding the reopening of interconnecting tube 514*g* and rotation of flat screws 526 into their uppermost position to allow fluid communication from support chamber 512*a* into collapsible reservoirs 516*a* and 516*c*. The process described above is then repeated to force the gas from reservoirs 516*a* and 516*c* into chambers 512*b* and 512*c* to further increase their stiffness. The CPU 202 can dynamically modify the process, while the shoes are being worn by their user, until any desired stiffness is obtained. In a similar manner, the effective volumes of chambers 512*a* and/or 512*d* can be adjusted by the CPU 202 commanding and performing similar manipulations on reservoirs 516*b* and 516*d*. In fact, by making use of all four reservoirs 516, gas may be transferred from any one of chambers 512 to any of the other chambers to increase or decrease the stiffness of the bladder at a desired location, to thereby tune the overall cushioning characteristics of the midsole for a particular activity or for a specific gait characteristic of the wearer.

For example, a wearer who tends to strike the ground at the midfoot or the forefoot may prefer that forefoot chamber 512*a* be more compliant. In this case, the fluid pressure could be transferred to the three rearward chambers. Similarly, a wearer who strikes the ground at the lateral rear may prefer that chamber 512*d* be less resistant and that forefoot chamber 512*a* be more resistant, in which case the fluid pressure could be transferred to chamber 512*a* from chamber 512*d*.

Furthermore, the overall pressure in chambers 512*a–d* and thus element 510 as a whole, can be reduced by increasing the available volume to include reservoirs 516*a–d*. For example, interconnecting tubes 514*a*, 514*b*, 514*e*, and 514*f* could be closed to isolate reservoirs 516*a–d* from support chambers 512*a–d*. Reservoirs 516*a–c* could be compressed to force fluid into reservoir 516*d*. Thereafter, connector 514*d* could be closed to isolate reservoir 516*d*. Reopening connectors 514*a*, 514*b*, and 514*e* and allowing reservoirs 516*a–c* to expand by rotating flat screws 526 into their uppermost positions would lower the pressure in support chambers 512*a–c*. The process could then be repeated for reservoir 516*c* to further lower the overall pressure in bladder 510.

Although as shown in FIG. 4, cushioning element 510 includes two separate bladder elements, that is, chamber 512*a* is formed as a separate element from chambers 512*c–d*, cushioning element 510 could be a single integral element in which chamber 512*a* could extend rearwardly to the forward boundary of chambers 512*b* and 512*d*, with foam element 513 eliminated. However, the portion of chamber 512*a* which would be disposed in the arch area of the shoe would be thinner than the remainder of chamber 512*a*, so as to allow pinch-off valves 518 to be disposed either above or below chamber 512*a*, and would include cylindrical holes formed therethrough for placement of reservoir chambers 516. Separate wall elements having internal threading could be disposed in the holes to allow for the use of flat screws 526. In this construction, chamber 512*a* would still be isolated by an internal wall from fluid communication with chambers 512*b* and 512*d*. Of course, bladder 510 could be formed as a single element, including reservoirs 516.

D. Operation of the Cushioning System

A user wears the shoes containing the dynamically controlled cushioning system much like a regular pair of shoes. However, he or she can quickly adjust the cushioning of the shoes by manipulating one or more of the control knobs 210*a–c*.

For example, in a running shoe application, as a person increases speed, the impact force will increase. The chambers receiving the increased impact force will increase in stiffness by increasing pressure from the variable reservoir 516 or by closing the valves for those chambers, or both. Similarly, in a basketball shoe, when landing on the heel chambers after a jump, the pressure on those chambers in increased by using the variable To decrease stiffness of the chambers, for example, in both the forefoot and heel chambers, such as in a walking shoe application, the forefoot and heel clambers can be made to be fluidly linked, thus increasing the total volume which results in a less stiff feel. A user can dynamically control the softness level by adjusting one or more of the control knobs.

Similarly, the side-to-side stiffness can be easily adjusted to correct a wearer's over or under-pronation. For example, if a wearer walks or runs in an over-pronated manner, pressure in the chambers on the medial side may be increased, either automatically by the CPU 202, or by a user selecting an appropriate setting on a control knob 210*c* (FIG. 8), to make that side of the cushioning support more stiff, and thereby reducing the wearer's tendency to over-pronate. To correct under-pronation, pressure in the chambers on the lateral side of the shoe may be increased in a similar manner.

The present invention provides for an infinite number of variations of pressure and thus stiffness at various locations in the midsole, without requiring that gas be supplied to or released from the bladder. That is, the variations in pressure are achieved in a closed system. Thus, the attendant drawbacks of open air systems such as leakage or the requirement for an external pump are avoided. It is preferred that reservoir chambers 516 be placed in the arch of midfoot area as shown. This area receives relatively low loads and a closed reservoir in this location which would yield limited cushioning would not pose a problem, especially where foam element 513 is used. However it is possible to locate the reservoirs and control system components at any convenient location, even outside of the midsole such as on the upper. Although one particular configuration of the various support chambers, reservoirs and control system is shown, other configurations could be used. For example, chamber 512*a* or 512*d* could be broken into several smaller chambers linked in fluid communication by interconnecting tubes.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

What is claimed is:

1. An article of footwear having a controlled cushioning system, the system comprising:

a fluid-filled bladder received within a sole of the article of footwear, said bladder being closed to ambient air and having a plurality of separate cushioning chambers in fluid communication with each other;

a plurality of pressure detectors, at least one of said plurality of pressure detectors being connected to each of said plurality of chambers;

a plurality of regulators, one of said plurality of regulators being connected to each of said plurality of chambers for regulating the level of fluid communication of the connected chamber with at least one other of said plurality of chambers;

a control system connected to the article of footwear, said control system communicating with said plurality of pressure detectors for detecting real time pressure in each of said plurality of chambers, communicating with each of said plurality of regulators to control actuation of each of said plurality of regulators for regulating the level of fluid communication of one of said plurality of chambers in relation to another of said plurality of chambers, and modulating the level of fluid communication between said plurality of chambers by actuating said plurality of regulators in a sequence to maintain a select pressure in each of said plurality of chambers.

2. The controlled cushioning system of claim 1, wherein said control system further includes:

a central processing unit received within said article of footwear;

a power source for powering said central processing unit; and, wherein each of said plurality of pressure detectors is a transducer received within each said plurality of chambers and in electrical communication with said central processing unit.

3. The controlled cushioning system of claim 2, wherein each of said plurality of regulators is an electronically-actuated valve in electrical communication with said central processing unit.

4. The controlled cushioning system of claim 2, further including a user input device for selectively commanding said central processing unit to set said select pressure in one of said plurality of chambers.

5. The controlled cushioning system of claim 1, further including a plenum joining said plurality of chambers in fluid communication.

6. The controlled cushioning system of claim 1, further including a variable volume reservoir in fluid communication with said cushioning chambers, said variable volume reservoir having:

a regulator in communication with, and actuated by, said control system for regulating the level of fluid communication of the reservoir with the chambers;

a pressure detector in communication with said control system for detecting pressure in said reservoir; and an actuator for modulating the volume of said reservoir, said actuator in communication with said control system wherein said control system modulates the volume of said reservoir and the regulators in a predetermined sequence to obtain a preset pressure in each chamber.

* * * * *